US011066862B1

(12) United States Patent
Rowland

(10) Patent No.: US 11,066,862 B1
(45) Date of Patent: Jul. 20, 2021

(54) ELECTRONIC HINGE

(71) Applicant: Component Hardware Group, Inc., Lakewood, NJ (US)

(72) Inventor: James Rowland, Bayville, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 0 days.

(21) Appl. No.: 16/747,362

(22) Filed: Jan. 20, 2020

(51) Int. Cl.
*E05D 11/00* (2006.01)
*E05D 3/02* (2006.01)

(52) U.S. Cl.
CPC ..... *E05D 11/0081* (2013.01); *E05D 3/02* (2013.01); *E05D 11/0054* (2013.01)

(58) Field of Classification Search
CPC .... E05D 11/0081; E05D 3/02; E05D 11/0054
See application file for complete search history.

(56) References Cited

U.S. PATENT DOCUMENTS 36,976 A * 11/1862 Acker ..... E05F 1/1215 16/300
3,860,312 A * 1/1975 Gordon, Jr. ..... E05D 11/0081 439/31
3,903,567 A * 9/1975 Suska ..... E05F 1/1215 16/301
3,965,533 A * 6/1976 Frohlich ..... E05F 1/1215 16/300
3,978,551 A * 9/1976 Mochizuki ..... E05F 1/1215 16/301
4,073,038 A * 2/1978 Curry ..... E05F 1/1215 16/301
4,102,013 A * 7/1978 Newlon ..... E05D 5/128 16/222
4,141,123 A * 2/1979 Newlon ..... E05D 5/128 29/11
4,339,845 A * 7/1982 Newlon ..... E05F 1/1215 16/300
4,419,788 A * 12/1983 Prout ..... E05F 1/1215 16/300
4,543,800 A * 10/1985 Mawby ..... E05D 11/0081 439/165
4,583,262 A * 4/1986 Werner ..... E05F 1/1215 16/300
4,756,051 A * 7/1988 Shy ..... E05F 3/14 16/299
4,839,939 A * 6/1989 O'Brien, II ..... E05D 11/0081 16/223
5,586,895 A * 12/1996 Zehrung ..... E05D 11/0081 16/223
5,606,774 A * 3/1997 Wu ..... E05D 3/12 16/283
6,256,839 B1 * 7/2001 Wu ..... E05D 3/12 16/283

(Continued)

*Primary Examiner* — Jeffrey O'Brien
(74) *Attorney, Agent, or Firm* — Francis C. Hand; Carella, Byrne Et Al.

(57) ABSTRACT

The electronic hinge has a flexible electrical cable that extends through an abutment of a support bracket, a hollow wire transfer pin mounted in the abutment, a wire transfer hub rotatably mounted on the wire transfer pin and the base of a wire transfer bracket. A spring assembly with a coiled torsion spring is provided for biasing the wire transfer bracket from an open position back to a closed position.

8 Claims, 5 Drawing Sheets

(56) References Cited

U.S. PATENT DOCUMENTS 6,616,467 B2 * 9/2003 Ibaraki ..... H04M 1/0216 439/165
6,728,557 B1 * 4/2004 Tracy ..... G06F 1/1616 439/13
6,812,407 B1 * 11/2004 Opperman ..... E05D 11/0081 16/2.2
7,669,289 B2 * 3/2010 Shih ..... E05D 11/0081 16/367
7,824,200 B2 * 11/2010 Bryla ..... G07C 9/00571 439/165
8,136,206 B2 * 3/2012 Endo ..... H04M 1/0222 16/367
8,250,713 B2 * 8/2012 Lin ..... E05D 11/0081 16/367
8,650,714 B2 * 2/2014 Staude ..... E05D 11/0081 16/386
8,724,306 B2 * 5/2014 Ashcraft ..... G06F 1/1681 361/679.27
8,753,129 B2 * 6/2014 Worley ..... H01R 35/04 439/31
9,725,939 B2 * 8/2017 Adair ..... E05D 11/0081
9,935,413 B1 * 4/2018 Fowle ..... H01R 35/02
10,066,868 B2 * 9/2018 Dolinsek ..... F25D 23/028
10,337,224 B1 * 7/2019 Shah ..... E05D 11/105
10,487,551 B2 * 11/2019 Soloski ..... E05D 11/0081
2002/0112320 A1 * 8/2002 Hayashi ..... E05D 11/0081 16/386
2004/0020011 A1 * 2/2004 Fang ..... E05D 3/08 16/302
2005/0241106 A1 * 11/2005 Sosa ..... E05F 1/1215 16/278
2007/0000090 A1 * 1/2007 Wu ..... E05F 1/1215 16/299
2007/0136991 A1 * 6/2007 Huang ..... E05F 1/1215 16/307
2007/0234513 A1 * 10/2007 Luo ..... G06F 1/1656 16/223
2007/0251261 A1 * 11/2007 Son ..... F25D 23/126 62/390
2008/0078062 A1 * 4/2008 Hsu ..... G06F 1/1616 16/367
2008/0078064 A1 * 4/2008 Lai ..... G06F 1/1683 16/387
2008/0282502 A1 * 11/2008 Lenze ..... E05D 11/0081 16/223
2011/0026204 A1 * 2/2011 Yang ..... G06F 1/1683 361/679.01
2014/0220790 A1 * 8/2014 Lee ..... H01R 35/04 439/31
2017/0122016 A1 * 5/2017 Lampitelli ..... E05D 11/0081
2017/0362870 A1 * 12/2017 Vera ..... E05F 1/1215
2020/0050000 A1 * 2/2020 Yoshida ..... H04N 5/64
2020/0177051 A1 * 6/2020 Abe ..... H02K 7/1853
2020/0181964 A1 * 6/2020 Wu ..... E05D 5/14
2020/0190881 A1 * 6/2020 Wu ..... E05D 3/12

* cited by examiner

ELECTRONIC HINGE

This invention relates to an electronic hinge. More particularly, this invention relates to an electronic hinge for a door having an electrical appliance therein or thereon.

As is known, various doors have been constructed to be mounted in hinged fashion to a cabinet or within a door frame. In particular, doors have been constructed to be hinged onto the front of a cabinet, such as a refrigerated cabinet used in many supermarkets, and the like. Typically, such a door is constructed of an insulated glass unit (IG unit) of rectangular shape with at least a pair of glass panes (or lites) and a perimeter spacer system that functions as a means for maintaining the glass panes in parallel spaced apart relation. In addition, in some cases, the glass unit has been electrically heated to prevent surface condensation on the glass panes while, in other cases, a light fixture has been incorporated in the glass unit to illuminate the interior of the cabinet on which the door is mounted.

In situations where electrically heated glass is required, the IG unit can be provided with a transparent electrically conductive heating film bonded to at least one of the panes and a pair of electrically conductive bus bars mounted in electrical contact on the coated pane or panes of glass on opposite sides of the coated pane or panes of glass.

Various types of electrical connectors have also been employed to deliver electrical power to the doors with 1G units, such as described in U.S. Pat. No. 3,760,157.

U.S. Pat. No. 10,167,657 describes a hinge assembly for an insulated door that provides for the delivery of electrical power through the hinge assembly to electrical appliances within a door.

Accordingly, It is an object of the invention to provide a hinge for a door on a cabinet or the like that allows for the delivery of electrical power through the hinge into an electrical appliance inside the door in a simple manner.

It is another object of the invention to deliver power through a hinge of a door to an appliance within the door.

Briefly, the invention provides an electronic hinge that is constructed to allow for the delivery of electrical power through the hinge. The hinge is particularly constructed to mount a door on a cabinet or frame and to deliver electrical power or information into an electrical appliance inside the door in a simple manner.

The hinge is comprised of a support bracket, a wire transfer bracket disposed for pivoting relative to the support bracket, a hub mounted to rotate with the transfer bracket and a flexible electrical cable extending through the support bracket and hub.

The support bracket is constructed to be mounted on the cabinet or frame and includes a pair of oppositely disposed abutments. In addition, a support pin is fixedly mounted in one of the abutments of the support bracket and a wire transfer pin is fixedly mounted in the other of the abutments of the support bracket with a collar at one end.

The wire transfer bracket is constructed to be mounted on a door and is disposed longitudinally between the abutments of the support bracket for pivoting with the door about a longitudinal axis between a closed position and an open position relative to the support bracket. In addition, the wire transfer bracket has a pair of oppositely disposed ears in each of which a bushing is fixedly mounted. One bushing is rotatably mounted on the support pin and the other bushing is rotatably mounted on the wire transfer pin to facilitate pivoting of the wire transfer bracket within the support bracket.

The hub is rotatably mounted on the collar of the wire transfer pin to pivot with the support bracket and has an opening in a side thereof.

The flexible electrical cable extends through one abutment of the support bracket, the wire transfer pin mounted therein and the wire transfer hub, exiting through the side opening in the hub, for example to an electrical appliance inside the door.

The hinge includes a longitudinally elongated cover that is slidably mounted on the ears of the wire transfer bracket to enclose the wire transfer bracket and the elements therein.

The hinge is also provided with a spring assembly for biasing the wire transfer bracket from the open position back to the closed position.

The spring assembly includes a support shaft having an end rotatably mounted in a bore at the end of the wire transfer hub, a support disc fixedly mounted on the support shaft and a coiled torsion spring concentrically disposed on the support shaft with a first end inserted in a recess of the support pin and a second end inserted in a recess of the support disc.

These and other objects of the invention will become more apparent from the following description taken in conjunction with the accompanying drawings wherein.

Figure 2:
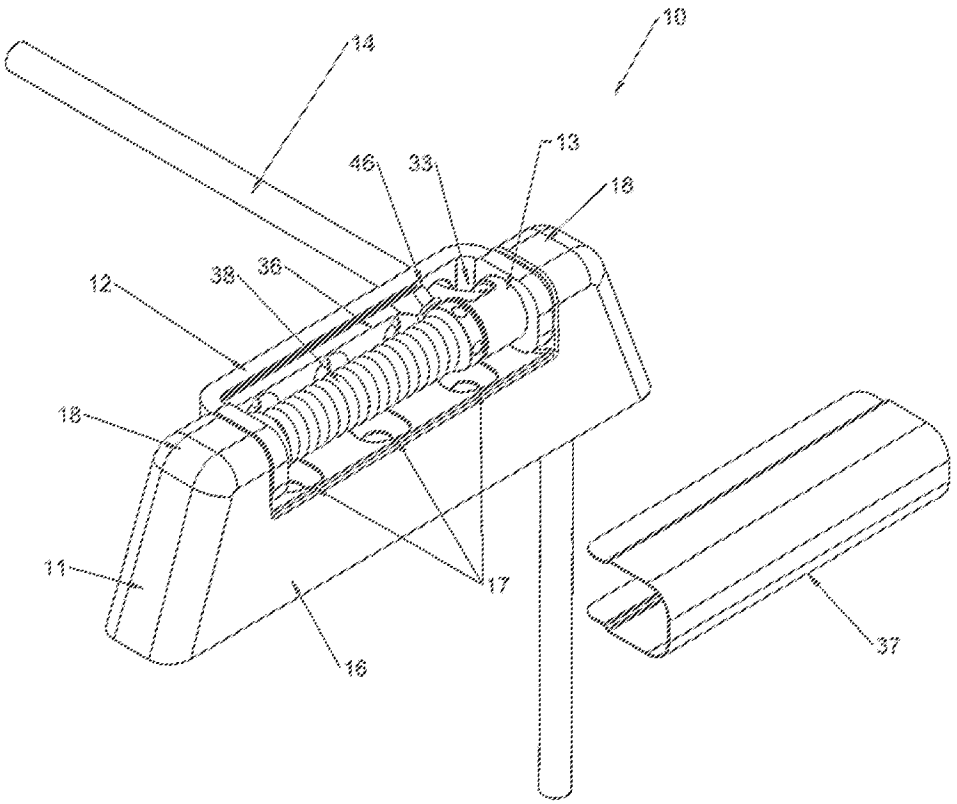
FIG. 2 illustrates an exploded perspective view of the hinge of FIG. 1 with the cover removed.
Figure 1:
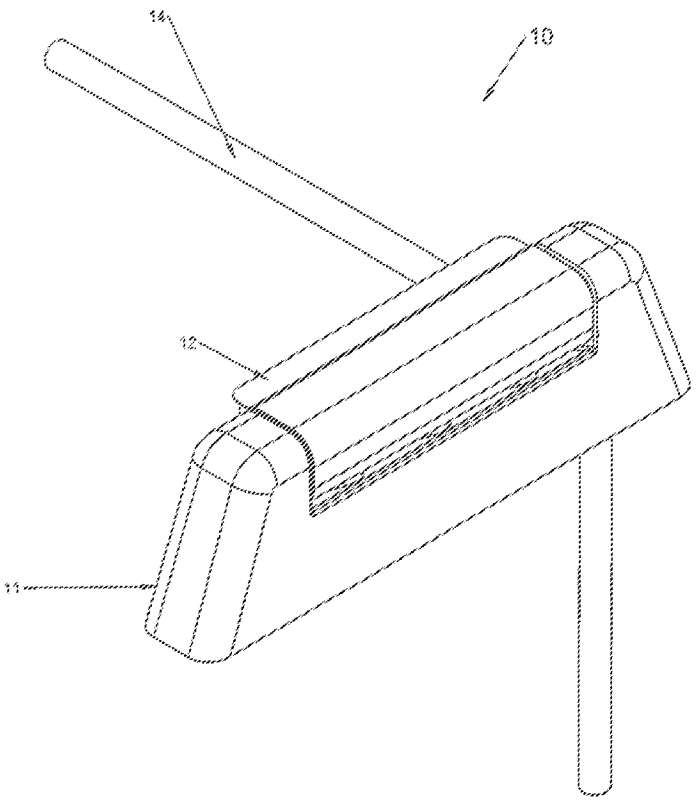
FIG. 1 illustrates a perspective view of a hinge constructed in accordance with the invention.

Referring to FIGS. 1 and 2, the electronic hinge 10 is comprised of a support bracket 11, a wire transfer bracket 12 disposed for pivoting relative to the support bracket 11, a hub 13 mounted to rotate with the transfer bracket 12 and a flexible electrical cable 14, e.g. a data pass through wire, extending through the support bracket 11 and hub 13.

The support bracket 11 is constructed to be mounted on a cabinet 15 (see FIG. 6) And is made of a suitable metal. The bracket 11 includes a base 16 having a plurality of longitudinally disposed mounting bores 17 for screws (not shown) to secure the support bracket 11 to the cabinet 15 and a pair of oppositely disposed abutments 18, each of which has a hollowed interior and which extends from the base 16.

Figure 3:
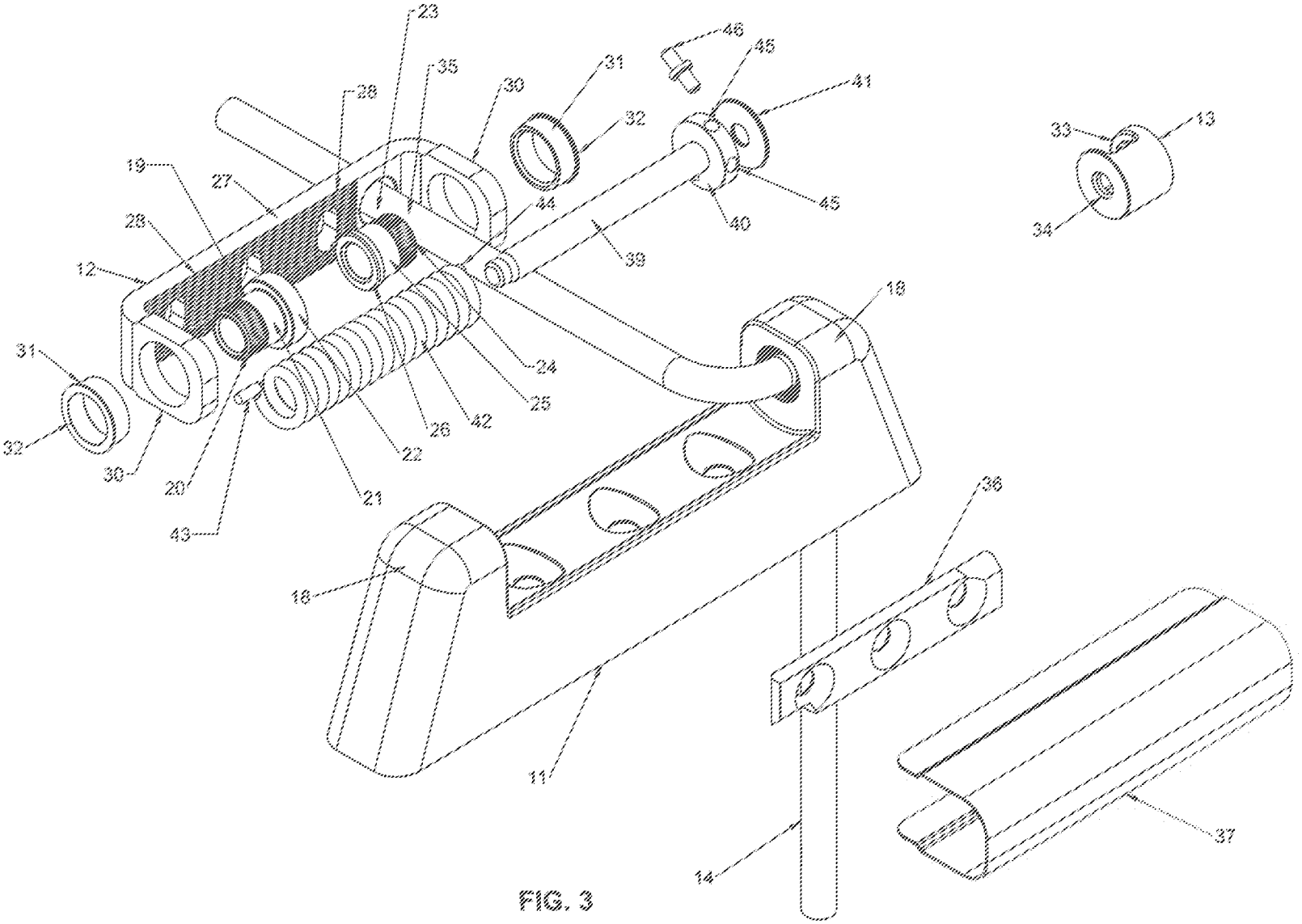
FIG. 3 illustrates an exploded perspective view of the hinge of FIG. 1.

Referring to FIG. 3, a hollow support pin 19 having a serrated end surface 20 is provided for fixedly mounting in one of the abutments 18 of the support bracket 11. In addition, the support pin 19 has a smooth circumferential surface 21 adjacent the serrated surface 20 and a collar 22 at one end.

Likewise, a hollow wire transfer pin 23 having a serrated end surface 24 is provided for fixedly mounting in the other abutment 18 of the support bracket 11 with an adjacent smooth surface 25 and a collar 26 at one end.

The wire transfer bracket 12 is disposed longitudinally between the abutments 18 of the support bracket 11 for pivoting about a longitudinal axis thereof between a closed position and an open position relative to the support bracket 11. The transfer bracket 12 has a rectilinear base 27 with a plurality of oval shaped bores 28 for screws (not shown) to secure the wire transfer bracket 12 to a door 29 (see FIG. 6) and a pair of oppositely disposed ears 30 that project from opposite ends of the base 27.

As indicated in FIG. 3, a pair of bushings 31 are provided to be fixedly mounted in the ears 30 of the wire transfer bracket 12 and to be mounted on the smooth surface 21 of the support pin 19 and the smooth surface 25 of the wire transfer pin 23 to facilitate pivoting of the wire transfer bracket 12 within the support bracket 11.

One bushing 31 has a collar 32 to be disposed between one ear 30 of the transfer bracket 12 and one abutment 18 and the other bushing 31 has a collar 32 to be disposed between the other ear 30 of the transfer bracket 12 and the other abutment 18.

Referring to FIGS. 2 and 3, the hub 13 is rotatably mounted on the collar 26 of the stationary wire transfer pin 23 and has an opening 33 in a side thereof and a bore 34 in an end thereof. The hub 13 has a smooth tight fitment around the wire transfer pin 23 such that the contact of the electrical cable 14 when the door and hinge is moved causes the hub 13 to rotate around wire transfer pin 23.

Figure 4:
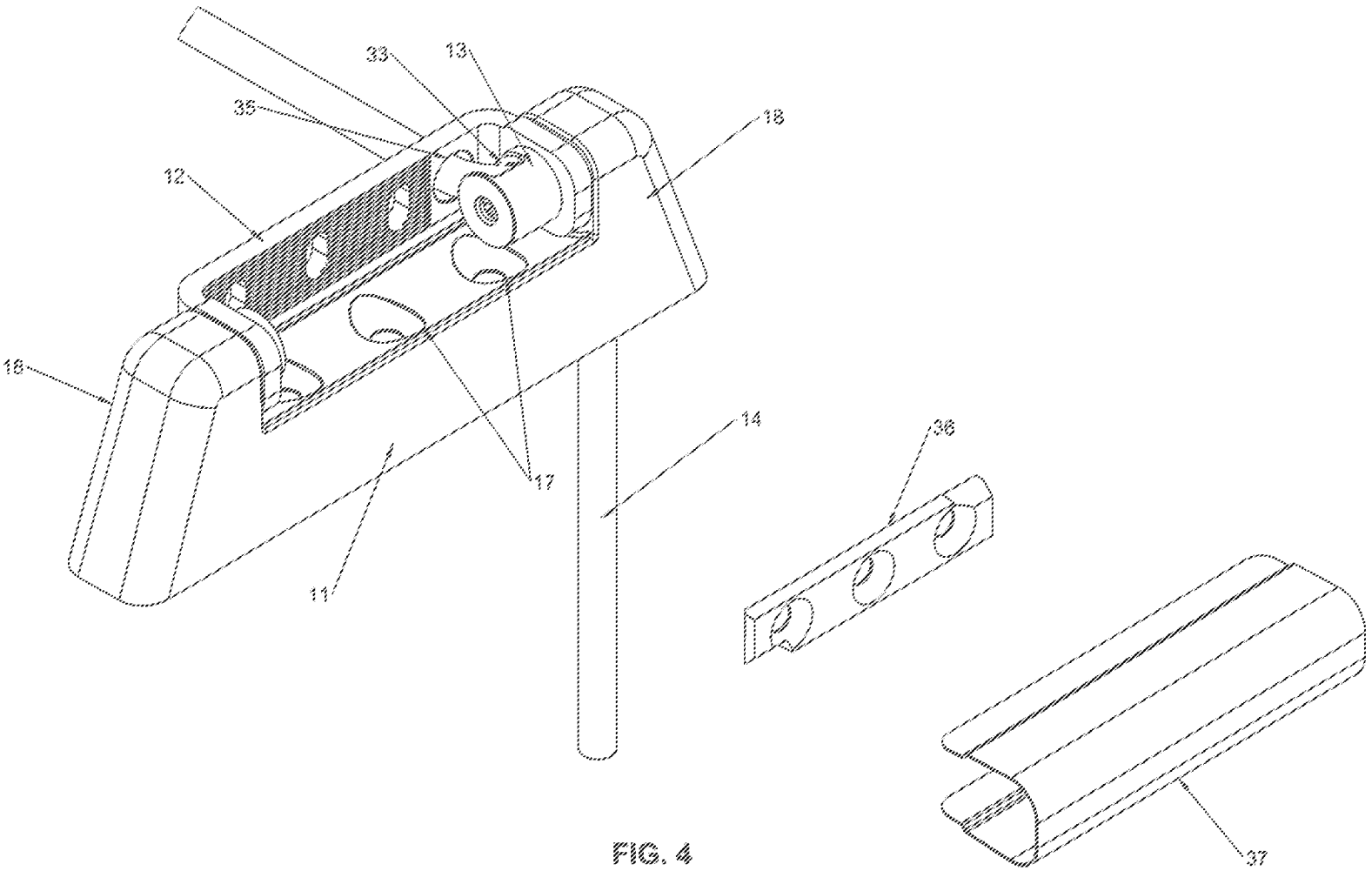
FIG. 4 illustrates an exploded perspective view of the hinge of FIG. 1 without the spring assembly.

As viewed in FIGS. 3 and 4, the flexible electrical cable 14 extends upwardly through one of the hollowed abutments 18 of the support bracket 11 and passes through the hollow wire transfer pin 23 mounted in the abutment 18. As shown in FIG. 2, the cable 14 passes through the hub 13 and out the side opening 33 to pass through an access opening 35 in the base 27 of the wire transfer bracket 12. During opening and closing of a door, the electrical cable 14 is allowed to twist.

Figure 6:
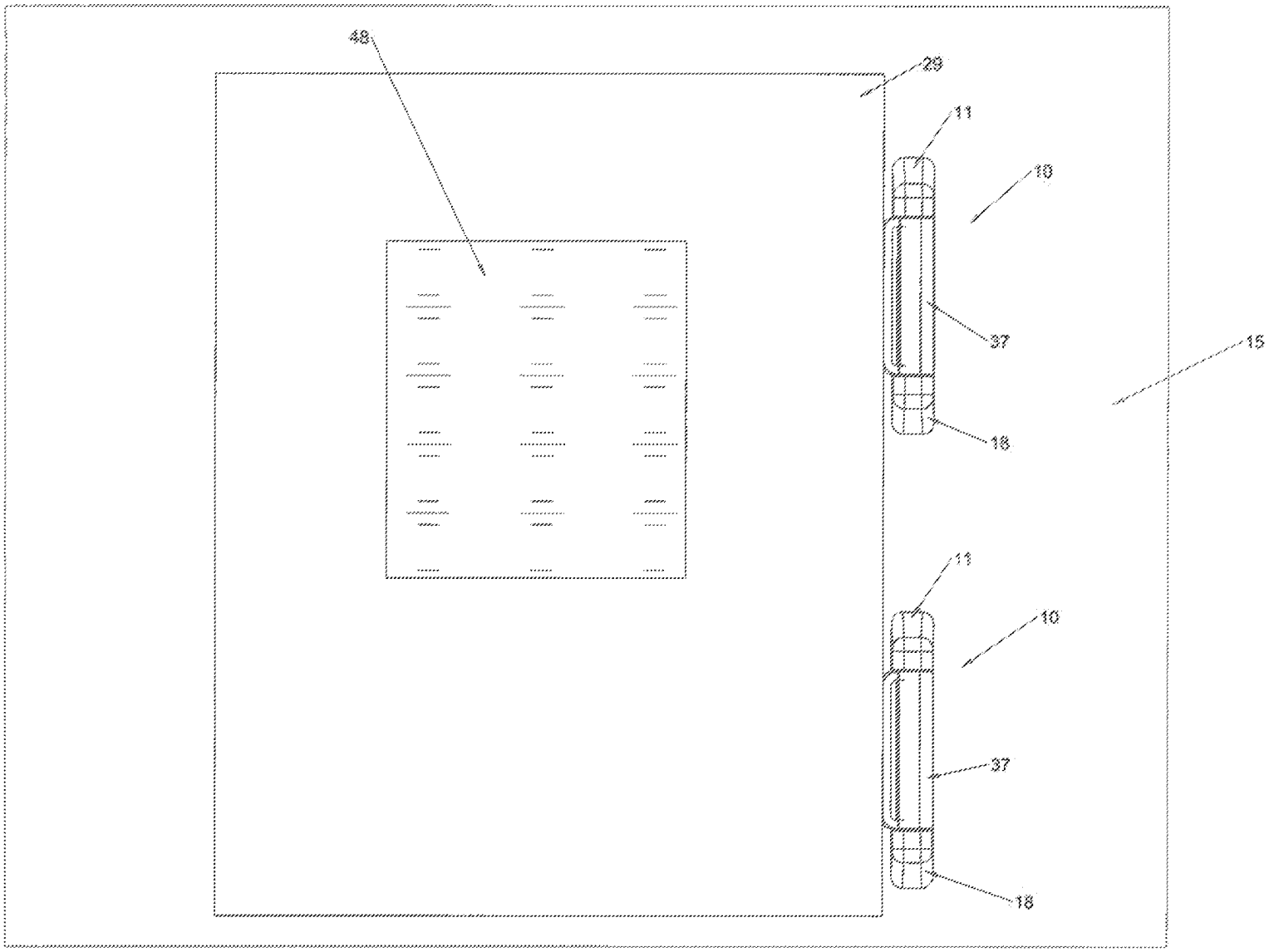
FIG. 6 illustrates a front view of a door mounted on a cabinet by a pair of hinges each of which is constructed as in FIG. 1.

Referring to FIGS. 2 and 3, an adjusting plate 36 is provided in known manner to face against a serrated surface on the base 27 of the wire transfer bracket 12 to allow for adjustments in the mounting of the wire transfer bracket 12 on the door 29 (see FIG. 6). In addition, a longitudinally elongated cover 37 is slidably mounted on the ears 30 of the wire transfer bracket 12 to enclose the interior of the wire transfer bracket 12.

Referring to FIG. 2, a spring assembly 38 is provided for biasing the wire transfer bracket 12 from the open position back to the closed position.

Figure 5:
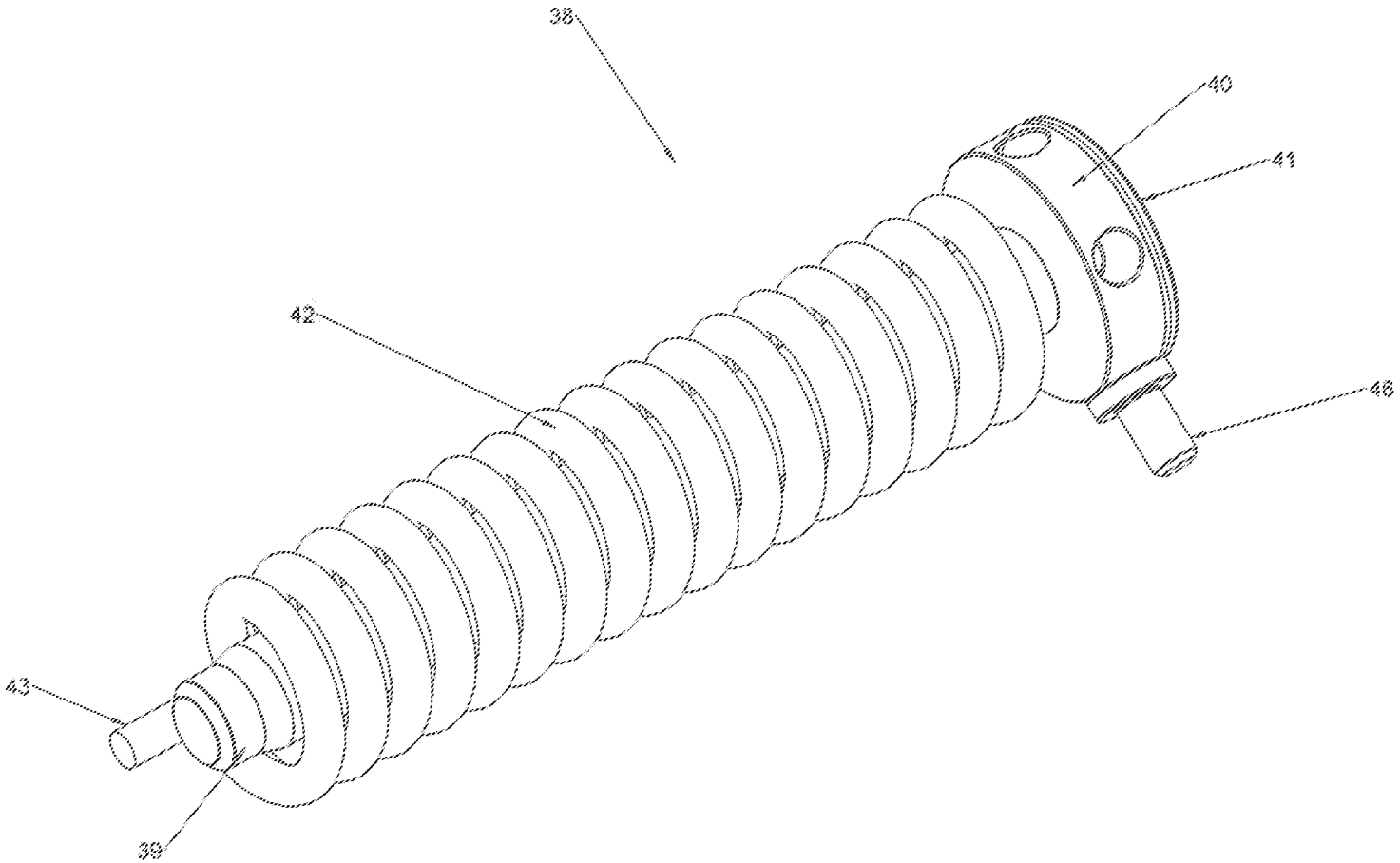
FIG. 5 illustrates a perspective view of the spring assembly of FIG. 2.

As indicated in FIGS. 3 and 5, the spring assembly 38 includes a support shaft 39 having one end for rotatably mounting in the hollow support pin 19 and an opposite end for rotatably mounting in the bore 34 of the wire transfer hub 13, a support disc 40 fixedly mounted on the support shaft 39 and a bushing 41 disposed between the support disc 40 and the wire transfer hub 13. In addition, the spring assembly 38 includes a coiled torsion spring 42 concentrically disposed on the support shaft 39 with a first end 43 inserted in a recess (not shown) of the support pin 19 and a second end 44 inserted in a recess (not shown) of the support disc 40.

During assembly, the support shaft 39 of the spring assembly 38 is first inserted into the hollow support pin 19 while compressing the spring 42 and then the opposite end of the support shaft 39 is inserted into the wire transfer hub 13.

Referring to FIG. 3, the support disc 40 has a plurality of circumferentially spaced bores 45 in the periphery and a tension stop pin 46 is disposed in one of the bores 45 to abut the support bracket 11 to maintain tension in the spring 42.

In use, the support disc 40 is turned relative to the stationary hollow support pin 19 with a supplied tension pin (not shown) to turn the spring 42 and thus increase tension on the spring assembly 38. When a desired tension is met, the tension stop pin 46 is inserted into the bore closet to the wire transfer bracket 12 (see FIG. 2) to rest on the wire support bracket 12 and keep the tension on the spring 42. The added tension on the spring 42 will cause the hinge 10 to close after being opened.

Referring to FIG. 6, in use, a pair of hinges 10 is mounted on the cabinet 15 in order to secure the door 29 to the cabinet 15 and to allow the door 29 to be swung between a closed position and an open position.

Referring to FIGS. 1 and 2, when a hinge 10 is in use, the wire transfer bracket 12 pivots with the door (not shown) from the closed position shown in FIGS. 2 and 6 to an open position (not shown) under an opening force. During this time, the support disc 40 is caused to rotate via the tension stop pin 46 thereby twisting the torsion spring 42 about the support shaft 39. while the fixed end 43 of the torsion spring 42 remains in the support pin 19. At the same time, the hub 13 rotates around the stationary wire transfer pin 23.

Thereafter, when the opening force is removed, the door 29 is swung back to the closed position by the force of the torsion spring. 42.

As illustrated, the door 29 has a window 48 that is heated by an electrical appliance (not shown) that is powered by the cable 14 (FIG. 1) that passes into the door 29. The door 29 may also have another electrically powered appliance connected to the cable 14.

The invention thus provides an electronic hinge for a door on a cabinet or the like that allows for the delivery of electrical power or data through the hinge into an electrical appliance inside the door in a simple direct manner.

For example, the electronic hinge may be used with a display unit wherein a temperature sensing module inside a refrigerated cabinet delivers a signal representative of a sensed temperature within the cabinet through a data pass through wire extending through the hinge to a readout display on the door hinged to the cabinet.

The hinge may be supplied without the cable in place to allow a user to thread a desired cable through the hinge between a module inside the cabinet and an appliance in the door. Alternatively, where the hinge is supplied with a cable threaded therethrough, the ends of the cables may be provided with suitable adapters to electrically communicate with a wire emanating from a module inside a cabinet and a wire emanating from an electrical appliance in the door.

What is claimed is:

1. An electronic hinge comprising a support bracket having a pair of oppositely disposed abutments;

a wire transfer bracket disposed longitudinally between said abutments of said support bracket for pivoting about a longitudinal axis thereof between a closed position thereof and an open position thereof relative to said support bracket, said transfer bracket having a pair of oppositely disposed ears;

a support pin fixedly mounted in one of said abutments of said support bracket;

a first bushing fixedly mounted in one of said ears of said transfer bracket and rotatably mounted on said support pin;

a hollow wire transfer pin fixedly mounted in another of said abutments of said support bracket and having a collar at one end thereof;

a second bushing fixedly mounted in another of said ears of said transfer bracket and rotatably mounted on said transfer pin; and a wire transfer hub rotatably mounted on said collar of said wire transfer pin and having an opening in a side thereof for passage of an electrical cable therethrough.

2. A hinge as set forth in claim 1 further comprising a flexible electrical cable extending through said another abutment of said support bracket, said wire transfer pin and said opening of said wire transfer hub.

3. A hinge as set forth in claim 1 wherein said first bushing has a collar disposed between said one ear of said transfer bracket and said one of said abutments and said second bushing has a collar disposed between said another ear of said transfer bracket and said another of said abutments.

4. A hinge as set forth in claim 1 further comprising a spring assembly for biasing said wire transfer bracket from said open position to said closed position.

5. A hinge as set forth in claim 4 wherein said support pin has a recess therein and said wire transfer hub has a cylindrically shaped bore in one end thereof and wherein said spring assembly includes a support shaft having an end rotatably mounted in said bore of said wire transfer hub, a support disc fixedly mounted on said support shaft and having a recess therein, and a coiled torsion spring concentrically disposed on said support shaft with a first end inserted in said recess of said support pin and a second end inserted in said recess of said support disc.

6. A hinge as set forth in claim 5 further comprising a bushing disposed between said support disc of said spring assembly and said wire transfer hub.

7. A hinge as set forth in claim 5 wherein said support disc has a plurality of circumferentially spaced bores and wherein said spring assembly further includes a tension stop pin disposed in one of said bores and abutting said wire transfer bracket to maintain tension in said spring.

8. A hinge as set forth in claim 1 further comprising a longitudinally elongated cover slidably mounted on said ears of said wire transfer bracket to enclose said wire transfer bracket.

* * * * *